US007449102B2

(12) United States Patent
Kalnes

(10) Patent No.: US 7,449,102 B2
(45) Date of Patent: Nov. 11, 2008

(54) INTEGRATED PROCESS FOR THE PRODUCTION OF LOW SULFUR DIESEL

(75) Inventor: Tom N. Kalnes, LaGrange, IL (US)

(73) Assignee: UOP LLC, Des Plaines, IL (US)

( * ) Notice: Subject to any disclaimer, the term of this patent is extended or adjusted under 35 U.S.C. 154(b) by 243 days.

(21) Appl. No.: 11/302,652

(22) Filed: Dec. 14, 2005

(65) Prior Publication Data

US 2007/0131584 A1 Jun. 14, 2007

(51) Int. Cl.
*C10G 65/00* (2006.01)

(52) U.S. Cl. ..... 208/59; 208/86; 208/89; 208/108; 208/211; 208/212

(58) Field of Classification Search ..... 208/59, 208/86, 89, 108, 211, 212
See application file for complete search history.

(56) References Cited

U.S. PATENT DOCUMENTS

| | | | | |
|---|---|---|---|---|
| 4,810,361 | A | 3/1989 | Absil et al. | 208/213 |
| 5,403,469 | A | 4/1995 | Vauk et al. | 208/78 |
| 6,179,995 | B1 * | 1/2001 | Cash et al. | 208/89 |
| 2002/0112990 | A1 * | 8/2002 | Iaccino et al. | 208/210 |

* cited by examiner

*Primary Examiner*—Glenn Caldarola
*Assistant Examiner*—Prem C. Singh
(74) *Attorney, Agent, or Firm*—James C Paschall

(57) ABSTRACT

A process for the production of low sulfur diesel and a residual hydrocarbon stream containing a reduced concentration of sulfur. A residual hydrocarbon feedstock and a heavy distillate hydrocarbon feedstock are used in the process.

12 Claims, 1 Drawing Sheet

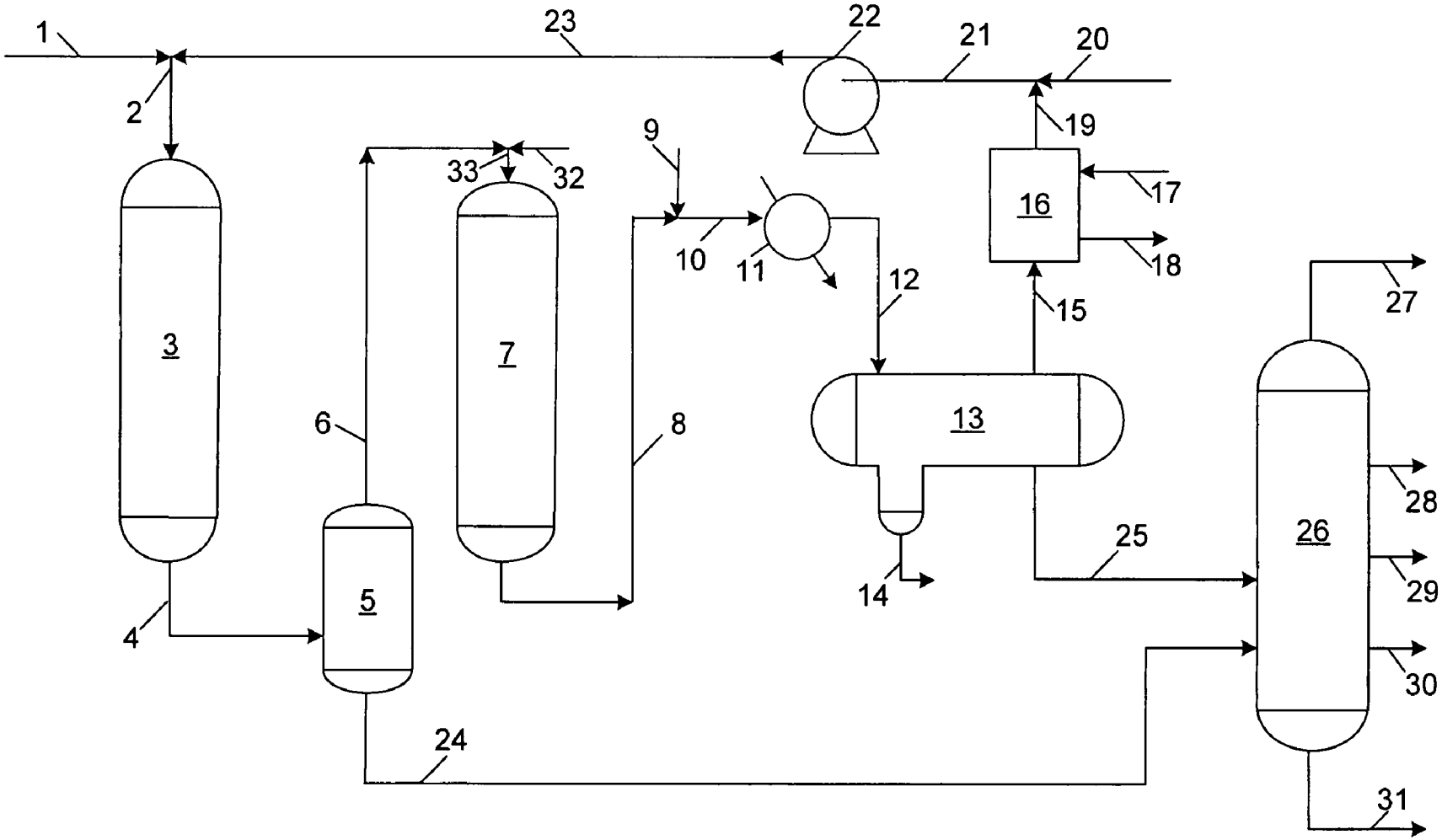
1
2
3
4
5
6
7
8
9
10
11
12
13
14
15
16
17
18
19
20
21
22
23
24
25
26
27
28
29
30
31
32
33

INTEGRATED PROCESS FOR THE PRODUCTION OF LOW SULFUR DIESEL

FIELD OF THE INVENTION

The field of art to which this invention pertains is the catalytic conversion of two low value hydrocarbon feedstocks to produce useful hydrocarbon products including low sulfur diesel by hydrocracking and hydrodesulfurization.

BACKGROUND OF THE INVENTION

Petroleum refiners produce desirable products such as turbine fuel, diesel fuel and other products known as middle distillates, as well as lower boiling hydrocarbonaceous liquids, such as naphtha and gasoline, by hydrocracking a hydrocarbon feedstock derived from crude oil or heavy fractions thereof. Feedstocks most often subjected to hydrocracking are gas oils and heavy gas oils recovered from crude oil by fractionation. A typical heavy gas oil comprises a substantial portion of hydrocarbon components boiling above 371° C. (700° F.), usually at least about 50% by weight boiling above 371° C. (700° F.). A typical vacuum gas oil normally has a boiling point range between about 315° C. (600° F.) and about 565° C. (1050° F.).

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen to yield a product containing a distribution of hydrocarbon products desired by the refiner.

Refiners also subject residual hydrocarbon streams to hydrodesulfurization to produce heavy hydrocarbonaceous compounds having a reduced concentration of sulfur. Residual hydrocarbons contain the heaviest components in a crude oil and a significant portion is non-distillable. Residual hydrocarbon streams are the remainder after the distillate hydrocarbons have been removed or fractionated from a crude oil. A majority of the residual feedstock boils at a temperature greater than about 565° C. (1050° F.). During the desulfurization of residual hydrocarbon feedstocks, a certain amount of distillate hydrocarbons are produced including diesel boiling range hydrocarbons. However, the diesel boiling range hydrocarbons thereby produced typically fail to qualify as ultra-low sulfur diesel because of their relatively high sulfur concentration. Although a wide variety of process flow schemes, operating conditions and catalysts have been used in commercial activities, there is always a demand for new hydroprocessing methods which provide lower costs, more valuable product yields and improved operability.

INFORMATION DISCLOSURE

U.S. Pat. No. 5,403,469 B1 (Vauk et al.) discloses a parallel hydrotreating and hydrocracking process. Effluent from the two processes are combined in the same separation vessel and separated into a vapor comprising hydrogen, and a hydrocarbon containing liquid. The hydrogen is shown to be supplied as part of the feed streams to both the hydrocracker and the hydrotreater.

U.S. Pat. No. 4,810,361 (Absil et al.) discloses a process for upgrading petroleum residua. The process comprises contacting a vacuum or atmospheric resid feed with a catalyst whereby the resid feedstock is simultaneously demetalized and desulfurized.

BRIEF SUMMARY OF THE INVENTION

The present invention is an integrated process for the production of low sulfur diesel and a residual hydrocarbon stream containing a reduced concentration of sulfur. The process of the present invention utilizes a residual hydrocarbon feedstock and a heavy distillate hydrocarbon feedstock. The residual hydrocarbon feedstock is reacted with a hydrogen-rich gaseous stream in a hydrodesulfurization reaction zone to produce diesel boiling range hydrocarbons and a residual product stream having a reduced concentration of sulfur. The effluent from the hydrodesulfurization reaction zone is separated in a hot, high pressure vapor liquid separator to produce a vaporous hydrocarbonaceous stream containing hydrogen and diesel boiling range hydrocarbons, and a residual liquid hydrocarbonaceous stream having a reduced concentration of sulfur. The vaporous stream containing diesel boiling range hydrocarbons and hydrogen is introduced along with a heavy distillate hydrocarbon stream into a hydrocracking reaction zone. The resulting effluent from the hydrocracking zone is separated in a cold vapor liquid separator to produce a hydrogen-rich gaseous stream which is preferably recycled to the desulfurization reaction zone. A liquid hydrocarbon stream containing ultra-low sulfur diesel is removed from the cold vapor liquid separator and is separated, preferably in a fractionation zone, to produce an ultra-low sulfur diesel product stream.

The integration of two hydroprocessing units utilizing a single hydrogen gas circuit minimizes the requirement for compression equipment and thereby reduces the investment and operating cost for processing two separate and independent feedstocks to produce more valuable product streams.

Other embodiments of the present invention encompass further details, such as detailed description of feedstocks, hydrodesulfurization catalyst, hydrocracking catalyst, and preferred operating conditions, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not to be a limitation thereof.

DETAILED DESCRIPTION OF THE INVENTION

The present invention is an integrated process for the hydrodesulfurization of a residual hydrocarbon feedstock and the hydrocracking of a heavy distillate hydrocarbon feedstock. Preferred residual hydrocarbon feedstocks to the hydrodesulfurization reaction zone include a vacuum or atmospheric resid produced during the fractionation of crude oil. Preferred residual hydrocarbon feedstocks have at least about 25 volume percent boiling at a temperature greater than 565° C. (1050° F.). A more preferred residual hydrocarbon feedstock has at least about 50 volume percent boiling at a temperature greater than 565° C. 1050° F.).

The residual hydrocarbon feedstock is reacted with a hydrogen-rich gaseous stream in a hydrodesulfurization reaction zone to produce diesel boiling range hydrocarbons and residual hydrocarbons containing asphaltenes and having a reduced concentration of sulfur. The hydrodesulfurization reaction zone performs non-distillable conversion of the feedstock as well as desulfurization. The resulting effluent from the hydrodesulfurization reaction zone is introduced into a hot, vapor-liquid separator preferably operated at a pressure from about 7.0 MPa (1000 psig) to about 20.7 MPa (3000 psig) and a temperature from about 204° C. (400° F.) to about 454° C. (850° F.) to produce a vaporous stream comprising diesel boiling range hydrocarbons and hydrogen, and a liquid hydrocarbonaceous stream comprising asphaltenes and having a reduced concentration of sulfur.

The hydrodesulfurization reaction zone is preferably operated at conditions including a temperature from about 260° C. (500° F.) to about 454° C. (850° F.) and a pressure from about 7.0 MPa (1000 psig) to about 20.7 MPa (3000 psig).

Suitable desulfurization catalysts for use in the present invention are any known convention desulfurization catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable desulfurization catalyst include zeolitic catalysts, as well as noble metal catalysts where the noble metal is selected from palladium and platinum. It is within the scope of the present invention that more than one type of desulfurization catalyst be used in the same reaction vessel. Two or more catalyst beds and one or more quench points may be utilized in the reaction vessel or vessels. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

The liquid hydrocarbonaceous stream comprising asphaltenes and having a reduced concentration of sulfur recovered from the hot, vapor liquid separator is preferably introduced into a fractionation zone to provide a feed for a fluid catalytic cracker or a low sulfur fuel oil product stream. The vaporous stream comprising diesel boiling range hydrocarbons and hydrogen from the hot, vapor liquid separator is admixed with a heavy distillate hydrocarbon feedstock and introduced into a hydrocracking zone containing hydrocracking catalyst and preferably operated at conditions including a temperature from about 260° C. (500° F.) to about 454° C. (850° F.) and a pressure from about 7.0 MPa (1000 psig) to about 14.0 MPa (2000 psig).

The integrated process of the present invention is particularly useful for hydrocracking a hydrocarbon oil containing hydrocarbons and/or other organic materials to produce a product containing hydrocarbons and/or other organic materials of lower average boiling point and lower average molecular weight. The hydrocarbon feedstocks that may be subjected to hydrocracking by the method of the invention include all mineral oils and synthetic oils (e.g., shale oil, tars and products, etc.) and fractions thereof. Illustrative hydrocarbon feedstocks include those containing components boiling above 288° C. (550° F.), such as atmospheric gas oils and vacuum gas oils. A preferred hydrocracking feedstock is a gas oil or other hydrocarbon fraction having at least 50% by weight, and most usually at least 75% by weight, of its components boiling at a temperature above about 288° C. (550° F.). One of the most preferred gas oil feedstocks will contain hydrocarbon components which boil above 288° C. (550° F.) with best results being achieved with feeds containing at least 25 percent by volume of the components boiling between 315° C. (600° F.) and 565° C. (1050° F.).

The hydrocracking zone may contain one or more beds of the same or different catalyst. In one embodiment the preferred hydrocracking catalysts utilize amorphous bases or low-level zeolite bases combined with one or more Group VIII or Group VIB metal hydrogenating components. In another embodiment the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms. It is preferred to employ zeolites having a silica/alumina mole ratio between about 3 and 12. Suitable zeolites found in nature include, for example, mordenite, stillbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms, wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 371°-648° C. (700°-1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The resulting effluent from the hydrocracking zone is preferably contacted with an aqueous stream to dissolve any ammonium salts, partially condensed and then introduced into a high pressure vapor-liquid separator operated at a pressure substantially equal to the hydrocracking zone and a temperature in the range from about 38° C. (100° F.) to about 71° C. (160° F.). An aqueous stream is recovered from the vapor-liquid separator. A hydrogen-rich gaseous stream is removed from the vapor-liquid separator to provide at least a majority and preferably all of the hydrogen introduced into the integrated hydrodesulfurization reaction zone. A liquid hydrocarbonaceous stream comprising lower boiling hydrocarbons and diesel boiling range hydrocarbons having a reduced sulfur concentration is recovered from the high pressure vapor liquid separator and separated to recover a stream comprising diesel boiling range hydrocarbons having a reduced sulfur concentration. This separation is preferably conducted in a fractionation zone to not only provide a stream comprising diesel boiling range hydrocarbons but other valuable distillate hydrocarbon streams such as gasoline and kerosene, for example. This fractionation zone may be the same as or different than the fractionation zone described hereinabove.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

Referring now to the drawing, an asphaltene containing residual hydrocarbon feedstock is introduced into the process via line 1 and is admixed with a hydrogen-rich recycle gas stream provided via line 23 and the resulting admixture is carried via line 2 and introduced into hydrodesulfurization zone 3. A resulting effluent from hydrodesulfurization zone 3 is carried via line 4 and introduced into hot vapor liquid separator 5. A vaporous hydrocarbonaceous stream containing diesel boiling range hydrocarbons is removed from hot vapor liquid separator 5 via line 6 and joins a heavy distillate hydrocarbon feedstock provided via line 32 and the resulting admixture is introduced via line 33 into hydrocracking zone 7. The resulting effluent is removed from hydrocracking zone 7 via line 8 and joins an aqueous stream provided via 4 line 9 and the resulting admixture is introduced into heat exchanger 11 via line 10. The resulting partially condensed stream is removed from heat exchanger 11 via line 12 and introduced into cold vapor liquid separator 13. An aqueous stream containing inorganic compounds is removed from cold vapor liquid separator 13 via line 14 and recovered. A hydrogen-rich gaseous stream containing hydrogen sulfide is removed from cold vapor liquid separator 13 via line 15 and introduced into absorption zone 16. A lean amine absorption solution is introduced via line 17 into absorption zone 16 and a rich amine solution containing hydrogen sulfide is removed from absorption zone 16 via line 18 and recovered. A hydrogen-rich gas having a reduced concentration of hydrogen sulfide is removed from absorption zone 16 via line 19 and is admixed with a make-up hydrogen stream provided via line 20 and the resulting admixture is carried via line 21 and introduced into compressor 22. A resulting compressed hydrogen-rich gaseous stream is removed from compressor 22 via line 23 and is introduced into hydrodesulfurization zone 3 via lines 23 and 2 as hereinabove described. A liquid hydrocarbonaceous stream containing diesel boiling range hydrocarbons is removed from cold vapor liquid separator 13 via line 25 and introduced into fractionation zone 26. A hot liquid hydrocarbonaceous stream containing asphaltenes and having a reduced concentration of sulfur is removed from hot vapor liquid separator 5 via line 24 and introduced into fractionation zone 26. A normally gaseous hydrocarbon stream carried via line 27 and a naphtha-containing stream carried via line 28 are removed from fractionation zone 26 and recovered. A kerosene-containing stream carried via line 29 and a diesel-containing stream carried via line 30 are removed from fractionation zone 26 and recovered. A heavy hydrocarbonaceous stream containing asphaltenes and having a reduced concentration of sulfur is removed from fractionation zone 26 via line 31 and recovered.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

A vacuum resid feedstock having the characteristics presented in Table 1 and in an amount of 56.5 mass units is introduced into a hydrodesulfurization reaction zone operated at a pressure of 19.4 MPa (2800 psig) and a temperature of 399° C. (750° F.) to produce an effluent stream comprising diesel boiling range hydrocarbons and having a reduced concentration of sulfur. The hydrodesulfurization reaction zone effluent stream is introduced into a hot, vapor-liquid separator operated at a pressure of 18.7 MPa (2700 psig) and a temperature of 404° C. (760° F.) to provide a hydrocarbonaceous vapor stream comprising hydrogen, hydrogen sulfide, normally gaseous hydrocarbons and about 9 mass units of naphtha and diesel. A liquid hydrocarbonaceous stream comprising distillable vacuum gas oil having a reduced concentration of sulfur and non-distillable hydrocarbonaceous compounds is recovered from the hot, vapor-liquid separator. A blend of vacuum gas oil and heavy coker gas oil (VGO/HCGO) having the characteristics presented in Table 1 is introduced into a hydrocracking reaction zone together with the hereinabove described hydrocarbonaceous vapor stream. The effluent from the hydrocracking zone produced 5.2 mass units of hydrogen sulfide, 17.6 mass units of $C_1$-$C_6$ hydrocarbons and 83 mass units of naphtha and diesel having a sulfur level less than 10 wppm sulfur.

TABLE 1

| FEEDSTOCK ANALYSIS | VACUUM RESID | VGO/HCGO BLEND |
|---|---|---|
| Specific Gravity | 1.038 | 0.92 |
| Distillation, ° C. (° F.) | | |
| IBP | 307 (585) | 230 (447) |
| 10 | 593 (1100) | 369 (698) |
| 30 | | 421 (788) |
| 50 | | 443 (829) |
| 70 | | 465 (869) |
| 90 | | 498 (929) |
| EP | 620 (1150) | 538 (998) |
| % over | 15 | 98 |
| Carbon Residue, weight percent | 23 | 0.2 |
| Metals, wppm | | |
| Ni | 45 | 0.2 |
| V | 165 | 0 |
| Sulfur, weight percent | 5.4 | 2.2 |
| Nitrogen, weight percent | 0.5 | 0.11 |
| Carbon Residue, weight percent | 23 | 0.2 |
| Heptane Insolubles, weight percent | 13.6 | <0.05 |

The foregoing description, drawing and illustrative embodiment clearly illustrate the advantages encompassed by the process of the present invention and the benefits to be afforded with the use thereof.

What is claimed is:

1. An integrated process for the production of ultra-low sulfur diesel from low quality feedstocks which process comprises:

(a) reacting an asphaltene-containing feedstock having at least a portion boiling at greater than 565° C. (1050° F.) and hydrogen in a hydrodesulfurization reaction zone containing hydrodesulfurization catalyst to produce a hydrodesulfurization reaction zone effluent stream comprising diesel boiling range hydrocarbons and having a reduced concentration of sulfur, and hydrogen;

(b) separating the hydrodesulfurization reaction zone effluent stream to provide a vaporous stream comprising both diesel boiling range hydrocarbons and hydrogen, and a liquid hydrocarbonaceous stream comprising asphaltenes and having a reduced concentration of sulfur;

(c) reacting the vaporous stream comprising diesel boiling range hydrocarbons and hydrogen from step (b) and a distillate hydrocarbon feedstock in a hydrocracking zone containing hydrocracking catalyst to produce a hydrocracking zone effluent stream comprising lower boiling hydrocarbons, diesel boiling range hydrocarbons having a reduced sulfur concentration, and hydrogen; and (d) separating the hydrocracking zone effluent stream comprising lower boiling hydrocarbons, diesel boiling range hydrocarbons having a reduced sulfur concentration, and hydrogen to provide a hydrogen rich gaseous stream and diesel boiling range hydrocarbons having a reduced concentration of sulfur.

2. The process of claim 1 wherein at least 25 volume percent of the asphaltene-containing feedstock of step (a) boils at a temperature greater than 565° C. (1050° F.).

3. The process of claim 1 wherein the distillate hydrocarbon feedstock in step (c) boils in the range from about 315° C. (600° F.) to about 565° C. (1050° F.).

4. The process of claim 1 wherein the hydrodesulfurization reaction zone is operated at conditions including a pressure from about 7.0 MPa (1000 psig) to about 20.7 MPa (3000 psig) and a temperature from about 204° C. (400° F.) to about 454° C. (850° F.).

5. The process of claim 1 wherein the hydrocracking zone is operated at conditions including a pressure from about 7.0 MPa (1000 psig) to about 20.7 MPa (3000 psig) and a temperature from about 260° C. (500° F.) to about 426° C. (800° F.).

6. The process of claim 1 wherein the diesel boiling range hydrocarbons having a reduced concentration of sulfur contain less than about 100 ppm sulfur.

7. An integrated process for the production of ultra-low sulfur diesel from low quality feedstocks which process comprises:

(a) reacting an asphaltene-containing feedstock having at least a portion boiling at greater than 565° C. (1050° F.) and hydrogen in a hydrodesulfurization reaction zone containing hydrodesulfurization catalyst and operated at conditions including a pressure from about 7.0 MPa (1000 psig) to about 20.7 MPa (3000 psig) and a temperature from about 204° C. (400° F.) to about 454° C. (850° F.) to produce a hydrodesulfurization reaction zone effluent stream comprising diesel boiling range hydrocarbons and having a reduced concentration of sulfur, and hydrogen;

(b) separating the hydrodesulfurization reaction zone effluent stream to provide a vaporous stream comprising both diesel boiling range hydrocarbons and hydrogen, and a liquid hydrocarbonaceous stream comprising asphaltenes and having a reduced concentration of sulfur;

(c) reacting the vaporous stream comprising diesel boiling range hydrocarbons and hydrogen from step (b) and a distillate hydrocarbon feedstock in a hydrocracking zone containing hydrocracking catalyst and operated at conditions including a pressure from about 7.0 MPa (1000 psig) to about 20.7 MPa (3000 psig) and a temperature from about 260° C. (500° F.) to about 454° C. (850° F.) to produce a hydrocracking zone effluent stream comprising lower boiling hydrocarbons, diesel boiling range hydrocarbons having a reduced sulfur concentration, and hydrogen; and (d) separating the hydrocracking zone effluent stream comprising lower boiling hydrocarbons, diesel boiling range hydrocarbons having a reduced sulfur concentration, and hydrogen to provide a hydrogen rich gaseous stream and diesel boiling range hydrocarbons having a reduced concentration of sulfur.

8. The process of claim 7 wherein at least 25 volume percent of the asphaltene-containing feedstock of step (a) wherein boils at a temperature greater than 565° C. (1050° F.).

9. The process of claim 7 wherein the distillate hydrocarbon feedstock in step (c) boils in the range from about 315° C. (600° F.) to about 565° C. (1050° F.).

10. The process of claim 7 wherein the diesel boiling range hydrocarbons having a reduced concentration of sulfur contain less than about 100 ppm sulfur.

11. An integrated process for the production of ultra-low sulfur diesel from low quality feedstocks which process comprises:

(a) reacting an asphaltene-containing feedstock having at least 25 volume percent boiling at a temperature greater than 565° C. (1050° F.), and hydrogen in a hydrodesulfurization reaction zone containing hydrodesulfurization catalyst and operated at conditions including a pressure from about 7.0 MPa (1000 psig) to about 20.7 MPa (3000 psig) and a temperature from about 204° C. (400° F.) to about 454° C. (850° F.) to produce a hydrodesulfurization reaction zone effluent steam comprising diesel boiling range hydrocarbons and having a reduced concentration of sulfur, and hydrogen;

(b) separating the hydrodesulfurization reaction zone effluent stream to provide a vaporous stream comprising both diesel boiling range hydrocarbons and hydrogen, and a liquid hydrocarbonaceous stream containing asphaltenes and having a reduced concentration of sulfur;

(c) reacting the vaporous stream comprising diesel boiling range hydrocarbons and hydrogen from step (b) and a distillate hydrocarbon feedstock boiling in the range from about 315° C. (600° F.) to about 565° C. (1050° F.) in a hydrocracking zone containing hydrocracking catalyst and operated at conditions including a pressure from about 7.0 MPa (1000 psig) to about 20.7 MPa (3000 psig) and a temperature from about 260° C. (500° F.) to about 454° C. (850° F.) to produce a hydrocracking zone effluent stream comprising lower boiling hydrocarbons, diesel boiling range hydrocarbons having a reduced sulfur concentration, and hydrogen; and (d) separating the hydrocracking zone effluent stream comprising lower boiling hydrocarbons, diesel boiling range hydrocarbons having a reduced sulfur concentration and hydrogen to provide a hydrogen rich gaseous stream and diesel boiling range hydrocarbons having a reduced concentration of sulfur.

12. The process of claim 11 wherein the diesel boiling range hydrocarbons having a reduced concentration of sulfur contain less than about 100 ppm sulfur.

* * * * *